United States Patent [19]

Basler

[11] Patent Number: 5,057,207

[45] Date of Patent: Oct. 15, 1991

[54] PROCESS FOR REDUCING HALOGEN IMPURITIES IN OIL PRODUCTS

[75] Inventor: Fritz Basler, Strengelbach, Switzerland

[73] Assignee: Geut AG, Zug, Switzerland

[21] Appl. No.: 431,946

[22] Filed: Nov. 3, 1989

[30] Foreign Application Priority Data

Jan. 4, 1989 [DE] Fed. Rep. of Germany ..... 3900159

[51] Int. Cl.[5] ..... C10G 17/00

[52] U.S. Cl. ..... 208/262.1; 208/180; 208/181; 208/265; 208/266; 208/273; 208/279; 208/280; 208/281; 208/302; 208/262.5

[58] Field of Search ..... 208/262.1, 180, 181, 208/265, 266, 273, 279, 280, 281, 302

[56] References Cited

U.S. PATENT DOCUMENTS

| | | | |
|---|---|---|---|
| 2,189,128 | 2/1940 | Breth et al. | 208/273 |
| 2,193,417 | 3/1940 | Cage | 208/273 |
| 2,320,629 | 6/1943 | Maluszak | 208/262.1 |
| 2,678,954 | 5/1954 | O'Neil et al. | 208/262.1 |
| 2,882,225 | 4/1959 | Johnston, Jr. | 208/266 |
| 3,528,909 | 9/1970 | White | 208/262.1 |
| 3,547,806 | 12/1970 | Matgear | 208/262.1 |
| 3,879,282 | 4/1975 | Johnson | 208/184 |
| 3,930,988 | 1/1976 | Johnson | 208/84 |
| 4,029,569 | 6/1977 | Ivey, Jr. | 208/181 |
| 4,151,072 | 4/1979 | Nowack et al. | 208/182 |
| 4,561,969 | 12/1985 | Janoski et al. | 208/262 |

*Primary Examiner*—Helane E. Myers

*Attorney, Agent, or Firm*—Kenyon & Kenyon

[57] ABSTRACT

The present invention provides a method for reprocessing, particularly the dehalogenation, of oil products which involves a) treating the oil product at temperatures up to about 150° C. with an effective amount of an aqueous solution of at least one compound selected from the group consisting of a strong acid, a salt of a weak base and a strong acid and precursors thereof; b) treating the oil product of step (a) at increased temperatures with at least one halogen binding agent; and c) separating water and/or the solids from the treated oil product of step (b).

22 Claims, No Drawings

PROCESS FOR REDUCING HALOGEN IMPURITIES IN OIL PRODUCTS

FIELD OF THE INVENTION

The present invention relates to a method for reducing the halogen content of oil products, particularly the dehalogenation of waste oil such as used lubricating oil.

BACKGROUND OF THE INVENTION

Efficient reconditioning of waste oils for reuse, so called recycling, is advantageous from both economic and ecological points of view. Use of reconditioned or recycled oils (hereafter reprocessed waste oil) as fuel or propellant is subject to governmental regulation in most countries because impurities therein may be released into the atmosphere creating an environmental hazard. In some cases, e.g., fuel oil applications, the impurity combustion products are most hazardous. Similar problems exist in other reprocessed waste oil applications, e.g., if they are used as base oil for the manufacture of lubricant oils.

The reprocessed waste oil impurities most commonly regulated for environmental reasons include inorganic and organic compounds of metals, of sulfur, of phosphorus, and the halogens, in particular of chlorine. Limiting the concentration of these impurities is particularly important when the reprocessed waste oil is to be used as base oil for the manufacturing lubricant oils.

Halogen compound concentration in reprocessed waste oil particularly chlorine compounds is of special importance because:

1. the halogen compounds present in the waste oils and their combustion products may be harmful to man and the environment;

2. the legal limits for the chlorine content of heating oils are very low; and 3 the efficient removal of high boiling point organic halogen compounds (e.g., chlorine) down to residual contents of less than about 100 mg chlorine/kg oil from waste oils has not been economically practical.

Conventional methods for the reprocessing of waste oils may involve acid treatment of the waste oil followed by a separation and neutralization of the resultant acid phase, and a thermal treatment step in which volatile fractions are driven off by distillation. In certain applications the reprocessed waste oils themselves are subsequently distilled.

Waste oil feedstocks such as used motor oil, typically contain about 1,000 to 10,000 mg or more of halogen per kg and are not adequately freed of halogens by the above conventional methods unless they are subjected to further treatment.

There are known methods that can remove halogen impurity from waste oils down to a concentration of about 100 mg/kg (expressed as chlorine $Cl_2$). These methods include, e.g., an after-treatment with additives which bind chlorine, such as alkali or alkaline earth metals, alkali or alkaline earth hydrodixes such as sodium or potassium hydroxide solution or calcium or magnesium hydroxide or alkali hydroxides in combination with selected solvents, and/or may involve hydrogenation processes.

These methods have one or more of the following disadvantages:

1. they do not lower the residual halogen content to below about 100 mg/kg (expressed as chlorine);

2 they require high temperatures that may effect considerable thermal breakdown of the treated waste oils;

3 the remaining halogen and reaction products can be present in a form difficult to separate, e.g., a sludge which is difficult to filter or to centrifuge;

4 they can give rise to hazardous residues which create additional disposal problems;

5 added halogen binding agents can significantly increase the ash content of the recycled waste oils; and 6. they require special safety devices and/or precautionary measures due to the chemicals used.

Hence the above described methods are not economically and/or technically practical for reducing the halogen content of the waste oil on a large scale.

U S. Pat. No. 3,930,988 is directed to a method for the reduction of the ash and metals content in used lubricating oils in which the used oil is contacted with an aqueous solution of ammonium sulfate and/or ammonium bisulfate at about 93° to 260° C. and about 750 psig to react with the metal compounds present thus forming separable metal containing solids. The reaction mixture is separated into an aqueous phase containing the solids and an oil phase having reduced metals and ash contents.

U.S. Pat. No. 3,879,282 is directed to a method for decreasing the ash and lead content in used motor oils wherein the used oil is brought into contact with an aqueous solution of ammonium phosphate which forms insoluble metal salts which are allowed to settle as precipitate. Thereafter, an oil product phase separated from the aqueous phase and precipitate.

U.S. Pat. No. 4,151,072 is directed to a method for reclaiming used lubricant oils regardless of contaminants or additive systems (impurities) contained therein, wherein, e.g., (a) used oil is contacted with an aqueous solution of an ammonium salt treating agent such as a salt selected from the group consisting of ammonium sulfate, ammonium bisulfate, ammonium phosphate, diammonium hydrogen phosphate, ammonium dihydrogen phosphate and mixtures thereof in appropriate quantities at a temperature of 60° to 120° C. (b) removing a major portion of the water and light hydrocarbons from the mixture of step (a) at a temperature of 110° to 140° C.; (c) separating the resulting oil phase by filtration; (d) heating the filtered oil phase to a temperature of 200° to 480° C. and contacting it with an adsorption agent. For some applications the resulting oil may be hydrogenated with hydrogen and a catalyst and then stripped at a temperature of 280° to 395° C.

DE-AS 25 08 713 is directed to a method for reprocessing used mineral oil involving pre-purification by means of coagulation, adsorption, filtration, distillation and a hydrogenation after-treatment. After the prepurification the oil is dehalogenated, fractionated, distilled, and hydrogenated. Dehalogenation is effected by treatment of the waste oil with an alkali metal, in particular Na or K, an alkaline earth metal, in particular Mg or Ca, an alkali, alkaline earth or aluminum alcoholate, and alkali hydride or alkali amide, an organic base, in particular pyridine or piperidine or with metallic aluminum or anhydrous aluminum chloride under conditions that exclude air and moisture, at a reaction temperature of 15° to 300° C.

DE-OS 36 37 255 is directed to a method for the reprocessing of waste oil wherein the waste oil is mixed at a pressure of 50° to 250 bar with a hydrogenous gas; at a reaction temperature of 350° to 500° C.; and solids are removed as sludge. An evaporated, oil-containing phase is withdrawn from the sludge and catalytically hydrogenated at temperatures of 300° to 400° C., the hydrogenated product is mixed with ammonia and degassed, and an ammonium chloride-containing aqueous phase is separated from the degassed product.

DE-OS 36 31 175 is directed to a method for the dehalogenation of hydrocarbon oils in which the hydrocarbon oils in a homogenous phase are treated at 120° to 400° C. with alkali or alkaline earth alcoholate having alkyl groups which contain 6 to 25. C atoms and the resultant alkali or alkaline earth halogenides are separated following the reaction.

DE-PS 36 00 024 is directed to a method for producing high-quality lubricant oils from waste oils through the catalytic hydrogenation of purified oil mixtures. The purified oil mixtures are freed of solids, as well as other dissolved and/or emulsified admixtures. The hydrogenating treatment is carried out in the presence of a commercially available hydrocracking catalyst at temperatures of 350° to 480° C. and pressures of 20 to 400 bar.

United Kingdom Patent No. 856,764 is directed to a method for decreasing the acidity of used lubricant oil wherein the oil is treated with ammonia.

The above-cited methods are either costly or otherwise lead to inefficient reprocessing of waste oils. Objects and Summary of the Invention

OBJECTS AND SUMMARY OF THE INVENTION

And objective of the present invetnion is to provide an economic and technically simple method for removing impurities, in particular halogen from various oil petroleum products such as hydrocarbon oils including waste oils, e.g., used motor oils.

It is another object of the present invention to provide a process for reprocessing of waste oils which employs small quantities of environmentally acceptable chemicals at relatively low temperatures and without the use of pressure.

It is another object of the present invention to provide a process for dehalogenation of waste oil that also produces a substantial decrease in the ash, phosphorus and metal contents cf the reprocessed waste oil.

It is yet another object of the present invention to provide a process that produces minimal amounts of waste and minimal losses of reprocessed waste oil and the oils reprocessed in accordance with the method are particularly useful as a pre-stage feedstock in refining processes.

The present invention provides a process for reducing impurities in oil products comprising the steps of:

a) treating the oil product at temperatures up to about 150° C. with an effective amount of an aqueous solution of at least one compound selected from the group consisting of a strong acid, a salt of a weak base and a strong acid and precursors thereof;

b) treating increased temperatures with at least one halogen binding agent; and c) separating water and/or the solids from the treated oil product of step (b).

The method of the invention is described in greater detail below.

DETAILED DESCRIPTION OF THE INVENTION

In general step (a) of the invention is carried out at temperatures of up to about 150° C, preferably about 20° to 150° C., and more preferably are about 80° to 120° C., in a conventional stripping apparatus. The duration of step (a) is preferably about 1 to 2 hours.

In step (a) the waste oil product is treated with an effective amount of an aqueous solution of at least one strong acid and/or of at least one salt of a weak base and a strong acid or of a precursor thereof. The quantities of aqueous solution used depend on the particular impurities present in the oil product and are generally in an amount less than or about equal to the equivalent weight of the impurities, particularly halogen compounds, to be removed from the waste oil. For reasons of economy, as small a quantity of aqueous solution as possible is preferred. Thus, in general quantities of aqueous solution below about 5 percent by weight of the waste oil, are preferred. Particularly preferred are quantities of aqueous solution below about 0.2 percent by weight of the oil product.

The strong acid used in step (a) can be any acid having a $pK_a$ greater than about 4 that is compatible with the desired product. Preferred strong acids include sulfuric acid, sulfurous acid, amido sulfuric acid, sulfonic acid, phosphoric acid, phosphorous acid, hypophosphorous acid, phosphonic acid, hydrochloric acid, hydrofluoric acid and mixtures thereof. Particularly preferred are sulfurous acid, phosphoric acid, phosphorous acid and phosphonic acid. The phosphoric acid may be an ortho- or meta-isomer or polyphosphoric acid.

The salt of a weak base and a strong acid is preferably an ammonium salt of a strong acid and the weak base has a $pK_b$ of about 4. Preferred ammonium salts include ammonium sulfate, ammonium bisulfate, ammonium sulfite, ammonium disulfite, ammonium amidosulfate, ammonium thiosulfate, ammonium sulfonate, ammonium phosphate, diammonium hydrogen phosphate, ammonium dihydrogen phosphate, ammonium amido, phosphate, ammonium phosphite, ammonium phosphonic acid, ammonium chloride, ammonium fluoride and mixtures thereof. Particularly preferred are ammonium sulfate, ammonium bisulfate, ammonium sulfite, diammonium hydrogen phosphate, ammonium dihydrogen phosphate, ammonium phosphite, and ammonium phosphonic acid. The ammonium phosphite may be mono-, di-, and/or triammonium phosphite.

Other compounds useful in step (a) include salts of guanidine or amides, such as carbamide or hydrazine; and alkyl or aryl compounds of the above listed acids such as dimethylphosphite, diethylphosphite or triethylphosphite.

Step (b) of the method according to the invention is preferably a coagulation step wherein dissolved and undissolved organic halogen compounds in the product of step (a) break down into hydrogen halides which are neutralized by the added halogen binding agents. The coagulation temperature is preferably about 250° to 300° C. and the duration of treatment about 0.5 to 24 hours, particularly preferred is a duration of about 3 to 24 hours. The preferred halogen binding agents are ammonia and/or an organic base. Preferred organic bases include urea, guanidine, hydrazine, hydrazine hydrate, carbazides, semicarbazides, piperazine, phenylene diamine, morpholine, diethanolamine, triethanolamine and salts of these compounds.

Preferably the coagulation is carried out in heat exchangers so that the oil is heated in three stages and the oil from each stage is passed through a cascade tower. The addition of halogen binding agent (ammonia and/or an organic base) in this stage (b) causes the halogens (mainly chlorine) to be blown off and the corresponding ammonium compounds to be found with small quantities of water and oil in the condensate which is discarded. Alternatively, the ammonium compounds may be deposited as inert/oil-insoluble halogen salts A portion of the metal impurities in the treated oil may be simultaneously precipitated.

In step (c) of the method according to the invention the product of step (b) is separated from the water and/or solids. Since the product can be sedimented readily , it can, for example, be decanted whereby approximately 95% of the water and/or solids are removed. Thereafter, depending on its viscosity the oil can be heated to a temperature of about 60° to 150° C., and subsequently filtered, e.g., in a filter press to remove remaining solids.

Optionally, the product of step (a) can be cured before coagulation, e.g., by addition of an additive for enhancing separation of the oil in step (c), preferably at a temperature of about 140° to 200° C. and for a duration of about 1 to 2 hours. Preferred additives for enhancing separation include sodium, potassium or calcium hydroxide; sodium, potassium or calcium alcholate; a sodium, potassium or calcium salts of an organic acid such as sodium ethylate or sodium stearate, urea, hydrazine, guanidine, a carbazide or a salt of these compounds. If such a curing step is employed the treatment times in the subsequent coagulation step can be shortened.

Optionally, after the coagulation step, an after-treatment of the product of step (b) can be employed before the separation step (c). In after-treatment the product of step (b) is treated with an effective amount of the aqueous solution used in step (a), preferably at a temperature of less than about 100° C. This after-treatment step can be continued for about 1 to 24 hours. The after-treatment step is particularly useful suitable where a minimal quantity of the aqueous solution is used in step (a), e.g., less than about 0.2 percent by weight aqueous solution with respect to the waste oil.

Before the treatment of the waste oil in accordance with the method of the invention any conventional pre-treatment can be employed. Thus when a waste oil includes more than 5% wt. impurities a preliminary removal of water such as by centrifugation, decanting or distillation may be employed.

Reprocessed waste oil prepared by the method of the invention is particularly useful as a heating oil or as a base oil for the renewed manufacture of lubricating oils.

The following examples are intended to further illustrate without limiting the invention.

EXAMPLE 1

A 250 g sample of a waste oil containing 22% water, 15,000 ppm total chlorine, and 1.70% wt. ash was mixed at room temperature while being stirred with 2.5% wt. sulfuric acid (40%) and heated to 80° C. 1,000 ppm of demulsifier was added, and the mixture allowed to stand at this temperature for 8 hours The supernatant oil was then slowly heated to 150° C. producing a 4% wt. condensate phase having a chlorine content of 80,000 ppm and a 96% wt. residual oil phase having a chlorine content of 9,350 ppm. The oil phase was slowly heated to 280° C. and subsequently a total of 1.5 g ammonia bubbled therethrough. After 12 hours at this temperature and exposure to the ammonia the oil phase was cooled to 150° C. and vacuum filtered. The filtrate in the form of golden brown clear oil contained 240 ppm of chlorine and had an ash content of 0.01%. The filtered solids (2.7% wt.) contained 12,400 ppm of chlorine.

EXAMPLE 2

A 300 g sample of a waste oil mixture of primarily used motor and hydraulic oils having a water content of 3.5% wt., 3,600 ppm total chlorine, 850 ppm phosphorous, and 0.88% ash was mixed at 80° C. with 2.5% wt. of a 40% wt. aqueous solution of equal parts diammonium sulfite and ammonium sulfamide while being stirred and then slowly heated to 150° C. without stirring, i.e., 1 hour at 80° to 120° C. and 1 hour at 120° to 150° C. The residual oil (organochlorine content 2,200 ppm) was further heated rapidly to 280° C., and beginning at 200° C. a 90° C. hot 75% wt. aqueous solution of equal parts of carbamide and diethanolamine (total 4.0 g) was added dropwise. After 4 hours the mixture was cooled and vacuum filtered at 150° C. with 1% wt. silicic acid. The filtrate still contained 140 ppm of chlorine, 8 ppm of phosphorous, and had an ash content of 0.01% wt.

EXAMPLE 3

A 1 kg sample of a waste oil mixture of primarily machine oil containing 1.0% wt. water, 13,770 ppm total chlorine of which 12 mg were PCBs (polychlorinated biphenyl) was mixed at 90° C. with 20 ml of a 10% wt. solution of equal parts ammonium monohydrogen phosphate, ammonium dihydrogen phosphate, and diammonium phosphite and within 1 hour heated to 150° C. while stirring. The residual oil containing 13,500 ppm of chlorine was carefully mixed with 25 g of 90° C. hot, aqueous 75% wt. mixture of guanidine, carbamide and diethanol amine and within one-half hour further heated to 250° C., and subsequently a total of 1.2 g ammonia was bubbled through the mixture which was heated to 330° for a total of 6 hours. The oil was cooled and treated at 100° C. with 15 ml of the same 10% solution used initially and after 5 minutes mixed with 1,000 ppm of a demulsifier, and then allowed to stand for 12 hours at 90° C. The supernatant oil was decanted and filtered through a vacuum filter. The filtered oil still contained 60 ppm of chlorine of which 10 mg were PCB.

EXAMPLE 4

In this example the same starting oil was analyzed in each instance, i.e., unfiltered waste oil, with a chlorine content of 1,870 mg/kg and an ash content of 0.37%. The method with respect to the added agents varied, while the other conditions, namely temperature and treatment time were kept constant in the method steps (a) and (b).

Step (a) was carried out by treatment of the waste oil at 70° C. before stripping up to 140° C. Step (b) took place over five hours at 280° C.

Table 1 lists the compounds added in steps (a) and (b) as well as the chlorine and ash content as determined in the filtered oil after completion of these steps. The filterability of the oil after coagulation for five hours at 280° C. is also described.

From the data summerized in Table 1 the following conclusions can be drawn:

If neither an aqueous solution in accordance with step (a) nor a binding agent of step (b) of the invention are added to the waste oil (Experiment 1), some dehalogenation of the waste oil takes place, but the ash content remains high not showing any significant change.

Treatment of the waste oil according to step (b) of the method of the invention without the addition of an aqueous solution of a strong acid and/or a salt of a weak base and a strong acid in step (a) (Experiment 2), leads to the same results as obtained in Experiment 1. The chlorine content of the waste oil is decreased to some extent while the ash content is not reduced. This experiment shows that solely carrying out step (b) of the method according to the invention does not lead to the desired dehalogenation of the waste oil.

In Experiment 3 the waste oil was treated according to step (a) of the method according to the invention while in step (b) no halogen binding agent was added. Although a sufficient decrease of the ash content was achieved the chlorine content was only minimally reduced.

In Experiment 4, the method of the invention, a destabilization of the organochlorine compounds takes place in step (a) and the chlorine is then nearly completely removed in stage (b) and simultaneously the ash content is markedly reduced In conclusion it can be stated that for satisfactory dehalogenation and ash removal or demetalization of waste oil both steps (a) and (b) according to the invention are necessary wherein each step influences the other leading to improved halogen removal. The chemical treatment in step (a) destabilizes the chlorine compounds in the waste oil and also effects demetalization. The demetalization is not completed in step (a) only after the heat treatment in step (b) is maximum demetalization is achieved. Step (b) is also necessary for good filterability of the waste oil product. Furthermore, the dehalogenation after step (a) is achieved only to the degree to which chlorides present in the waste oil are precipitated or converted to halogenated solvents having a low boiling point that can be distilled off in a vapor phase. Residual halogen content in the oil after steps (a) and (b) is derived from organic and other dissolved compounds which remain stable throughout treatment in step (a), customarily up to cracking temperatures of about 350° C.

The treatment in step (a) at temperatures below 150° C. effects destabilization of these halogen compounds so that they split off hydrogen halides at temperatures of approximately 250° C. If the hydrogen halide is not removed from the oil mixture, the reaction is partially reversible and effective dehalogenation is only partially effective.

TABLE 1

Starting Oil: unfiltered waste oil
chlorine content (mg/kg): 1870
ash content (%): 0.37

| Experiment | Step (a) | Step (b) | Chlorine content (mg/kg) after step (a) | Chlorine content (mg/kg) after step (b) | Ash content (%) after step (a) | Ash content (%) after step (b) | Filterability |
|---|---|---|---|---|---|---|---|
| 1 | 2% $H_2O$ | | 540 | 345 | 0.36 | 0.38 | good |
| 2 | 2% $H_2O$ | $NH_3$ gas bubbled through | 540 | 290 | 0.36 | 0.39 | good |
| 3 | 2% $H_2O$<br>0.1% $H_2SO_4$<br>0.25% $H_3PO_3$<br>0.25% guanidine toluol sulfonic acid | | 480 | 300 | 0.14 | <0.01 | good |
| 4 | 2% $H_2O$<br>0.1% $H_2SO_4$<br>0.25% $H_3PO_3$<br>0.25% guanidine toluol sulfonic acid | $NH_3$ gas bubbled through | 480 | 40 | 0.14 | <0.01 | good |

I claim:

1. A method for reducing halogen impurities in oil products comprising the steps of:

(a) treating an oil product at temperatures up to about 150° C. with an aqueous solution of at least one compound selected from the group consisting of a strong acid, a salt of a weak base and a strong acid and precursors thereof;

(b) treating the oil product of step (a) at increased temperatures with at least one halogen binding agent selected from the group consisting of organic bases; and (c) separating dehalogenated oil from the product of step (b).

2. The method of claim 1 wherein the strong acid is selected from the group consisting of:

sulfuric acid, sulfurous acid, amido sulfuric acid, sulfonic acid, phosphoric acid, phosphorous acid, hypophosphorous acid, phosphonic acid, hydrochloric acid, hydrofluoric acid and mixtures thereof:

the salt of a strong acid and a weak base is selected from the group consisting of:

ammonium sulfate, ammonium bisulfate, ammonium sulfite, ammonium disulfite, ammonium amidosulfate, ammonium thiosulfate, ammonium sulfonate, ammonium phosphate, diammonium hydrogen phosphate, ammonium dihydrogen phosphate, ammonium amido phosphate, ammonium phosphite, ammonium phosphonic acid, ammonium chloride, ammonium fluoride, carbamide, hydrazine, dimethylphosphite, diethylphosphite and triethylphosphite; and the halogen binding agent of step (b) is selected from the group consisting of ammonia urea, guanidine, hydrazine, hydrazine hydrate, carbazides, semicarbazides, piperazine, phenylene diamine, morpholine, diethanolamine, triethanolamine and salts thereof.

3. A method for reducing the halogen content of waste oil, comprising the steps of:

(a) treating the waste oil at temperatures up to about 150° C. with an aqueous solution of at least one compound selected from the group consisting of a strong acid, a salt of a weak base and a strong acid and precursors thereof in an amount effective for reducing halogen impurities;

(b) treating the product of step (a) at increased temperatures with at least one halogen binding agent selected from the group consisting of organic bases, and (c) separating the dehalogenated oil from the product of step (b).

4. The method recited in claim 3, wherein step (a) is carried out in stripping apparatus.

5. The method recited in claim 3, wherein step (a) is carried out at a temperature of about 20° to 150° C.

6. The method recited in claim 5, wherein step (a) is carried out over about 1 to 2 hours.

7. The method recited in claim 5, wherein step (a) is carried out with about 5 percent by weight of the aqueous solution with respect to the waste oil.

8. The method as recited in claim 7, wherein step (a) is carried out with an aqueous solution including an acid selected from the group consisting of sulfuric acid, sulfurous acid, amidosulfuric acid, sulfonic acid, phosphoric acid, phosphorous acid, hypophosphorous acid, phosphonic acid, hydrochloric acid, hydrofluoric acid and mixtures thereof.

9. The method recited in claim 7, wherein step (a) is carried out with an aqueous solution including a compound selected from the group consisting of an ammonium salt of a strong acid and a precursor thereof.

10. The method recited in claim 9, wherein the ammonium salt is selected from the group consisting of ammonium sulfate, ammonium bisulfate. ammonium sulfite, ammonium disulfite, ammonium amidosulfate, ammonium thiosulfate, ammonium sulfonate, ammonium phosphate, diammonium hydrogen phosphate, ammonium dihydrogen phosphate, ammonium amidophosphate, ammonium phosphite, ammonium phosphonic acid, ammonium chloride and ammonium fluoride.

11. The method recited in claim 7 wherein step (a) is carried out with an aqueous solution including a compound selected from the group consisting of a guanidinium salt, an amide, alkyl and aryl compounds of a strong acid and precursors thereof.

12. The method recited in claim 8, 9 or 10, wherein step (b) is carried out at a temperature of about 200° to 350° C.

13. The method recited in claim 8, 9, or 10, wherein step (b) is carried out over about 0.5 to 24 hours.

14. The method recited in claim 8, 9 or 10, wherein the halogen binding agent in step (b) is selected from the group consisting of ammonia and an organic base.

15. The method recited in claim 8, 9 or 10, wherein the organic base is selected from the group consisting of ammonia urea, guanidine, hydrazine, hydrazine hydrate, a carbazide, a semicarbazide, piperazine, phenylenediamine, morpholine, diethanolamine, triethanolanine and salts thereof.

16. The method recited in claim 8, 9 or 10, wherein step (C) is carried out at a temperature of about 60° to 150 C.

17. The method recited in claim 8, 9 or 10, wherein between steps (a) and (b) a curing step is carried out.

18. The method recited in claim 17, wherein the curing step is carried out by treating the product of step (a) with at least one additive for the improvement of the separability of the dehalogenated oil in step (c).

19. The method recited in claim 18, wherein the additive is selected from the group consisting of sodium, potassium and calcium hydroxide, sodium, potassium and calcium alcoholate, sodium, potassium and calcium salts of organic acids, urea, hydrazine, guanidine, and a carbazide.

20. The method recited in claim 8, 9 or 10, wherein between steps (b) and (c) an after-treatment step is carried out.

21. The method recited in claim 20, wherein the after-treatment step is carried out by treating the product of step (b) with an effective amount of the aqueous solution used in step (a).

22. The method recited in claim 21, wherein the after-treatment step is carried out at a temperature of less than about 100° C. for a duration of about 1 to 24 hours.

* * * * *

UNITED STATES PATENT AND TRADEMARK OFFICE

CERTIFICATE OF CORRECTION

PATENT NO. : 5,057,207

DATED : October 15, 1991

INVENTOR(S) : Fritz BASLER

It is certified that error appears in the above-identified patent and that said Letters Patent is hereby corrected as shown below:

In Column 3, line 34, change "invetnion" to read --invention--;

in Column 3, line 62, change"...treating increased: to read --treating the oil product of step (a) at increased...--;

in Column 4, line 43, change "amido," to read --amido--;

in Column 5, line 12, change "salts" to read --salts.--;

in Column 5, line 44, delete "suitable";

in Column 8, line 45, change "thereof;" to read --thereof in an amount effective for reducing halogen impurities;--;

UNITED STATES PATENT AND TRADEMARK OFFICE

CERTIFICATE OF CORRECTION

PATENT NO. : 5,057,207

DATED : October 15, 1991

INVENTOR(S) : Fritz BASLER

It is certified that error appears in the above-identified patent and that said Letters Patent is hereby corrected as shown below:

In Column 9, line 4, change "ammonia urea" to read --ammonia, urea--;

in Column 10, line 19, change "ammonia urea" to read --ammonia, urea--:

in Column 10, line 25, change "150 C" to read --150°C--.

Signed and Sealed this

Thirteenth Day of April, 1993

*Attest:*

STEPHEN G. KUNIN

*Attesting Officer*

*Acting Commissioner of Patents and Trademarks*